US006323408B1

(12) United States Patent
Liu

(10) Patent No.: US 6,323,408 B1
(45) Date of Patent: Nov. 27, 2001

(54) MUSIC CREATION

(76) Inventor: Chi Fai Liu, 9 Willow Path, Palm Springs, Yuen Long, New Territories (HK)

( * ) Notice: Subject to any disclaimer, the term of this patent is extended or adjusted under 35 U.S.C. 154(b) by 0 days.

(21) Appl. No.: 09/514,643

(22) Filed: Feb. 29, 2000

(51) Int. Cl.[7] ..... G10C 3/12

(52) U.S. Cl. ..... 84/451; 84/454; 84/483.2; 84/DIG. 18; 84/600

(58) Field of Search ..... 84/451, 470 R, 84/471 R, 475, 600, 609, 622–625, 649, 659–660, 454, 477 R, 483.1, 483.2, 485 R, DIG. 18

(56) References Cited

U.S. PATENT DOCUMENTS 5,516,981 * 5/1996 Nagai ..... 84/451
5,900,571 * 5/1999 Partovi ..... 84/483.1
6,121,534 * 9/2000 Brsuh ..... 84/451
6,194,646 * 2/2001 Kowalski ..... 84/451

* cited by examiner

*Primary Examiner*—Marlon T. Fletcher
(74) *Attorney, Agent, or Firm*—Leydig, Voit & Mayer, Ltd.

(57) ABSTRACT

Templates are used in methods of improving the perceived intonation of musical notes by modifying each note to provide certain frequencies between adjacent pairs of notes. The template modifications provide, in a sequence of twelve notes per octave, or extended octave, that each note is separated from an adjacent note according to one of frequency ratios of 25/24 (h), 16/15 (m) and 27/25 (s). The templates can be used with keyboards and virtual keyboards and applied to recorded music, musical input signals, or data, as required.

18 Claims, 3 Drawing Sheets

Diagram showing same template applied to different keyboards with offset

Violin I (zero-th element on "A")

| | | | | | | | | | | | | | |
|---|---|---|---|---|---|---|---|---|---|---|---|---|---|
| element in template | 0 | 1 | 2 | 3 | 4 | 5 | 6 | 7 | 8 | 9 | a | b | 0 |
| interval | | h | m | m | h | s | h | s | h | m | m | h | s |
| ratios | | 25 / 24 | 16 / 15 | 16 / 15 | 25 / 24 | 27 / 25 | 25 / 24 | 27 / 25 | 25 / 24 | 16 / 15 | 16 / 15 | 25 / 24 | 27 / 25 |
| frequency in Hz | 223 | 232 | 248 | 264 | 275 | 297 | 309 | 334 | 348 | 371 | 396 | 413 | 446 |
| | A | | B | | C# | D | | E | | F# | G | | A |

Violin II (2-nd element on "A")

| | | | | | | | | | | | | | |
|---|---|---|---|---|---|---|---|---|---|---|---|---|---|
| element in template | 2 | 3 | 4 | 5 | 6 | 7 | 8 | 9 | a | b | 0 | 1 | 2 |
| interval | | m | h | s | h | s | h | m | m | h | s | h | m |
| ratios | | 16 / 15 | 25 / 24 | 27 / 25 | 25 / 24 | 27 / 25 | 25 / 24 | 16 / 15 | 16 / 15 | 25 / 24 | 27 / 25 | 25 / 24 | 16 / 15 |
| frequency in Hz | 220 | 235 | 244 | 264 | 275 | 297 | 309 | 330 | 352 | 367 | 396 | 412 | 440 |
| | A | A# | B | | C# | D | | E | | F# | G | | A |

Viola / Cello (5-th element on "A")

| | | | | | | | | | | | | | | |
|---|---|---|---|---|---|---|---|---|---|---|---|---|---|---|
| element in template | 5 | 6 | 7 | 8 | 9 | a | b | 0 | 1 | 2 | 3 | 4 | 5 |
| interval | | h | s | h | m | m | h | s | h | m | m | h | s |
| ratios | | 25 / 24 | 27 / 25 | 25 / 24 | 16 / 15 | 16 / 15 | 25 / 24 | 27 / 25 | 25 / 24 | 16 / 15 | 16 / 15 | 25 / 24 | 27 / 25 |
| frequency in Hz | 220 | 229 | 248 | 258 | 275 | 293 | 306 | 330 | 344 | 367 | 391 | 407 | 440 |
| | A | A# | B | | C# | D | | E | | F# | G | | A |

Block diagram of process flow, where an audio recording of a singing performance is being improved by each note being compared to the intonation desired and defined by the tuning table selected. Any out-of-tune note is being detected and adjusted by the computer. Choice of tuning table is through experience and aural evaluation.

Diagram showing same template applied to different keyboards with offset

Violin I (zero-th element on "A")

| | | | | | | | | | | | | | |
|---|---|---|---|---|---|---|---|---|---|---|---|---|---|
| element in template | 0 | 1 | 2 | 3 | 4 | 5 | 6 | 7 | 8 | 9 | a | b | 0 |
| interval | | h | m | m | h | s | h | s | h | m | m | h | s |
| ratios | | 25 / 24 | 16 / 15 | 16 / 15 | 25 / 24 | 27 / 25 | 25 / 24 | 27 / 25 | 25 / 24 | 16 / 15 | 16 / 15 | 25 / 24 | 27 / 25 |
| frequency in Hz | 223 | 232 | 248 | 264 | 275 | 297 | 309 | 334 | 348 | 371 | 396 | 413 | 446 |
| | A | | B | | C# | D | | E | | F# | G | | A |

Violin II (2-nd element on "A")

| | | | | | | | | | | | | | |
|---|---|---|---|---|---|---|---|---|---|---|---|---|---|
| element in template | 2 | 3 | 4 | 5 | 6 | 7 | 8 | 9 | a | b | 0 | 1 | 2 |
| interval | | m | h | s | h | s | h | m | m | h | s | h | m |
| ratios | | 16 / 15 | 25 / 24 | 27 / 25 | 25 / 24 | 27 / 25 | 25 / 24 | 16 / 15 | 16 / 15 | 25 / 24 | 27 / 25 | 25 / 24 | 16 / 15 |
| frequency in Hz | 220 | 235 | 244 | 264 | 275 | 297 | 309 | 330 | 352 | 367 | 396 | 412 | 440 |
| | A | A# | B | | C# | D | | E | | F# | G | | A |

Viola / Cello (5-th element on "A")

| | | | | | | | | | | | | | |
|---|---|---|---|---|---|---|---|---|---|---|---|---|---|
| element in template | 5 | 6 | 7 | 8 | 9 | a | b | 0 | 1 | 2 | 3 | 4 | 5 |
| interval | | h | s | h | m | m | h | s | h | m | m | h | s |
| ratios | | 25 / 24 | 27 / 25 | 25 / 24 | 16 / 15 | 16 / 15 | 25 / 24 | 27 / 25 | 25 / 24 | 16 / 15 | 16 / 15 | 25 / 24 | 27 / 25 |
| frequency in Hz | 220 | 229 | 248 | 258 | 275 | 293 | 306 | 330 | 344 | 367 | 391 | 407 | 440 |
| | A | A# | B | | C# | D | | E | | F# | G | | A |

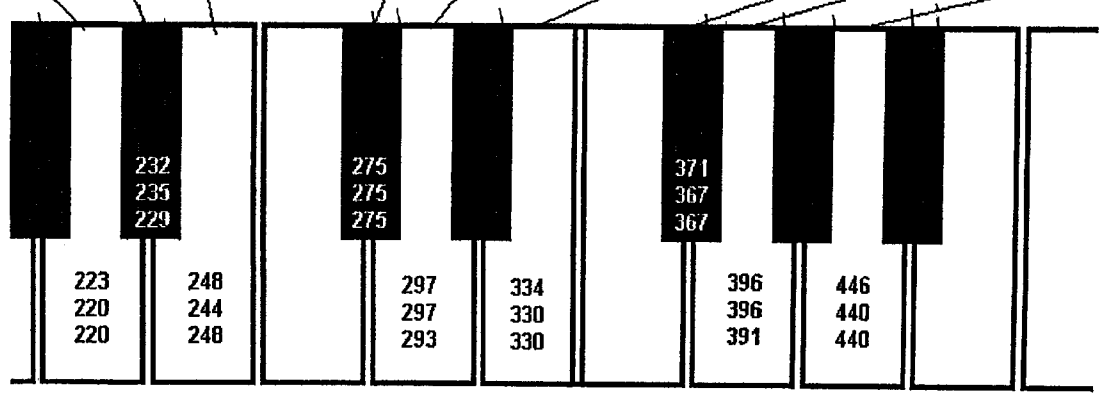

FIG. 4

MUSIC CREATION

BACKGROUND OF THE INVENTION

1. Field of the Invention

The invention relates to music creation, performance and reproduction.

2. Description of the Prior Art

It is common practice that the largest proportion of music is performed on instruments whose notes are tuned according to "EQUAL TEMPERAMENT". By "EQUAL TEMPERAMENT", it means that notes are derived from each octave being logarithmically divided into twelve divisions. This octave, with its twelve notes so divided, is duplicated above and beneath by each corresponding note being multiplied by factors of $n^{th}$ power of two. Since note "A" is traditionally assigned a frequency of 440 Hz, its octaves above and below by $n^{th}$ power of two is therefore . . . 110 Hz, 220 Hz, 880 Hz, 1760 Hz . . . etc, where n= . . . −2, −1, 1, 2, . . . The other eleven notes are logarithmically determined to have frequencies:

$$440*EXP(LOG(2)*n/12)Hz$$

where for note "A♯", n=1; for note "B", n=2; for note "C", n=3; for note "C♯", n=4 . . . etc.

The frequencies being calculated of the notes A♯, B, C, C♯, D, D♯, E, F, F♯, G, G♯, A' are hence 466.16 Hz, 493.88 Hz, 523.25 Hz, 554.37 Hz, 587.33 Hz, 622.25 Hz, 659.26 Hz, 698.16 Hz, 739.99 Hz, 783.99 Hz, 830.61 Hz and 880.00 Hz. These frequencies extend to the upper and lower octaves with frequencies multiplied by respective multiples of two for an "equal-tempered" keyboard (see FIG. 1).

Historically, there were proposals of other ways of deriving the frequencies of notes. Some of these ways involve arrangements of the scale such that the frequencies of its notes form simple ratios with one another, and are generally termed "PURE INTONATION". However, this has long been found to be theoretically and practically impossible to apply to instruments of pre-determined tuning, since it will result in "pure" intervals only between particular pairs of notes, but involves heavy penalties for other intervals. It has also been long realized that such formation will result in music performances that are rather unpleasant to the ears of a listener.

Furthermore, there exists no reliable theory to explain how music becomes "pleasant" to listen to. The sensors of the ear remain one of the most obscure subjects in the area of scientific research.

On the other hand, it is known that good violinists and singers do adjust each note's frequency during performances in real time so that each note deviates a little away from the "equally-tempered" frequencies, and hence render their performances significantly more pleasant to the listener. The converse is also true that poor performers appear to adjust in wrong ways and render their performances musically unpleasant. Very many proposals have been made over hundreds of years as to how notes scales and instruments should be tuned or adjusted. However, none of these proposals has yet been found compatible to aesthetically pleasing performances in the realms of classical, popular or traditional music.

For example, the following is such a proposal of a standard scale that fails to fulfil a requirement for good listening:

do 9/8 re 10/9 me 16/15 fa 9/8 so 10/9 la 9/8 te 16/15 do

This scale generates "good" major thirds (9/8*10/9=5/4), between note-pairs do/me, fa/la, so/te, and "good" minor thirds (9/8*16/15=6/5) between te/re, me/so, la/do. However, the scale produces a "bad" minor third (10/9*16/15=32/27) between re/fa. The scale also produces "Good" perfect fifth (9/8*10/9*9/8*16/15=3/2) between do/so and me/te, but "bad" fifth (10/9*16/15*9/8*10/9=40/27) between re/la. Performances in this scale arrangement sound strange and unnatural.

Historically, therefore, attempts were made to solve the problem of intonation on fixed-pitch instruments, in particular, keyboard instruments, by using multiple keys for each of the twelve notes in each octave. For example, the "bad" minor thirds (10/9*16/15=32/27) between re/fa may be overcome by the insertion of an extra key for re, so that instead of the:

do 9/8 re 10/9 me 16/15 fa 9/8 so 10/9 la 9/8 te 16/15 do, the scale now becomes:

do 10/9 $re_1$ 81/80 $re_2$ 10/9 me . . . etc

Additionally, the "bad" minor thirds (10/9*16/15=32/27) between re/fa is substituted by $re_1$/fa (10/9*81/80*16/15=6/5) instead, giving a "good" minor third.

Although such solutions may solve apparent "problems" for isolated instances of the sounding of two notes, it does not address the needs of harmonic music flow, nor offer any explanation why listeners, including children, can readily point out wrong notes in very complicated polyphony.

Instead of splitting up keys with its complication of more than the original twelve keys for each octave, another solution is providing more than one stave of keys for the instrument. Instruments such as the harpsichord and the pipe organ do in fact have more than one stave of keys. However, there is not found any record of any workable proposal of how these staves should be tuned so that the problem of intonation may be overcome.

SUMMARY OF THE INVENTION

It is an object of the present invention to overcome or at least reduce this problem.

According to one aspect of the invention there is provided keyboards, virtual keyboards, tuning tables, scales and the like for improving the perceived intonation of musical notes by modifying the notes using templates that provide frequency ratios between adjacent pairs of notes of 25/24 (h), 16/15 (m) and 27/25 (s), in a sequence of twelve notes that extends over each octave range or each extended octave range.

The twelve notes may be in the order s, h, m, h, s, h, s, m, h, m, h, m (template 1). The twelve notes may be in the order s, h, m, h, s, h, s, m, h, m, h, s (template 2). The twelve notes may be in the order h, s, m, h, s, h, s, m, h, m, h, s (template 3). The twelve notes may be in the order h, m, m, h, s, h, s, h, m, m, h, s (template 4). The twelve notes may be in the order s, h, s, h, s, h, m, m, h, m, h, m (template 5).

According to another aspect of the invention there is provided a method of improving the perceived intonation of a melody or melodies using keyboards, virtual keyboards, tuning tables, scales and the like using templates of claim 1 to modify each note of the melody that has been produced or written according to a standard equal-tempered musical scale by adjustments according to the templates.

An electronic music generator may comprise an audio output device, and a computer arranged to drive the output device, in which the computer is programmed to respond to musical input signals or data and to modify each note thereof using templates.

According to a further aspect of the invention there are provided keyboards, virtual keyboards, tuning tables, scales, and the like for improving the perceived intonation of music with two or more parts, in which a template specified above is used to modify notes in these parts and applied with offsets for some parts to make some of the same notes different in pitch between the parts.

The present invention provides a method to tune each and every note on a fixed-tuning instrument to achieve an intonation compatible to a good performance that inherently allows a free-tuning environment. It is also possible to change the individual notes of audio signals, including voice signals, so as to improve and render a melody, or singing voice aesthetically more pleasing. It has been technically possible in the past to make individual adjustments as such signals can be presented individually using known computer programs for appropriate adjustments to a programmed computer. However, so far no overall pre-ordained new scales, or chord matching, has been available to be applied to a flow of notes in a melody that serve to generate a good overall performance. In other words, at present or in the past, a note or several notes of pre-recorded music may be changed to make them sharper and/or flatter for example, as perceived preferable to the ear of a music recordings producer. However, to do this the producer can use only his trained instinct, or personal preferences to make and to judge the amount of adjustment required. In contrast, embodiments of the present invention enable specific new scales to be applied so that individual notes can each be suitably adjusted by pre-ordained amounts that are required according to the invention to render the overall melody compatible to a good performance.

It will be noted that for some of the above scales, the sum of the frequency ratios of each octave of twelve notes add up to more than 2 to 1. In fact they add up to give an octave ratio range of 81 to 40. In this specification, an octave range of frequencies in the ratio of 81 to 40 is referred to as an "extended octave range".

BRIEF DESCRIPTION OF THE DRAWINGS

Embodiments of the invention will now be explained by way of example with reference to the accompanying drawings in which:

FIG. 4 is a diagram showing offset use of a template for modifying different parts of a piece of music.

DESCRIPTION OF THE PREFERRED EMBODIMENT

Figure 1:
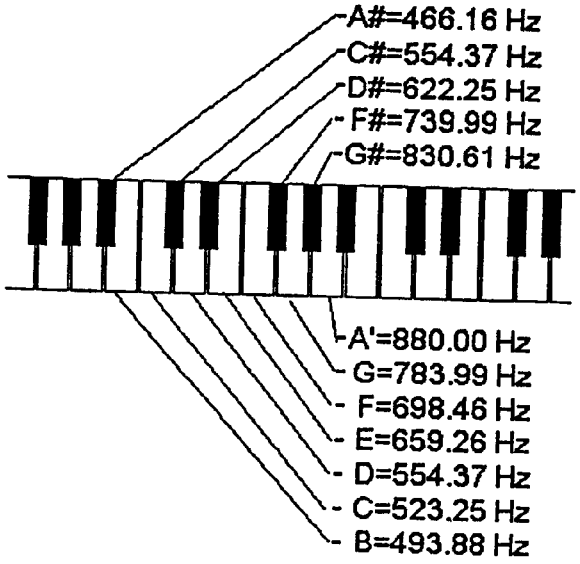
FIG. 1 PRIOR ART
FIG. 1 shows an equal tempered key board tuned according to a standard scale.
Figure 2:
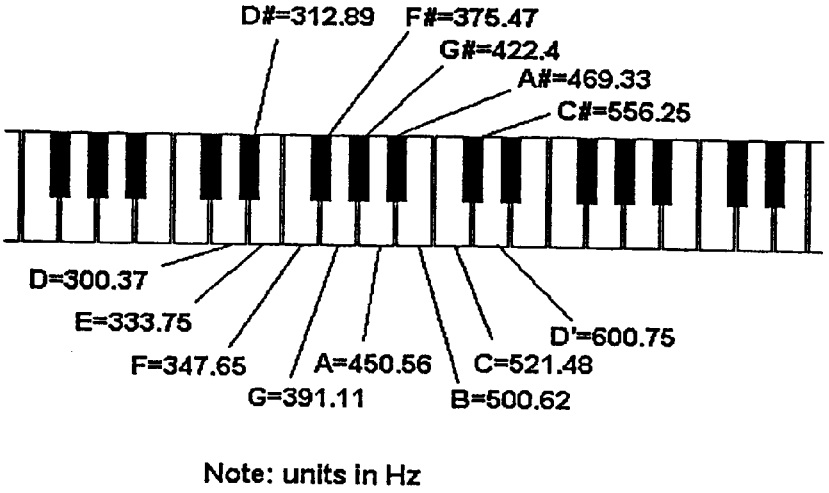
FIG. 2 shows a keyboard tuned to a scale of the present invention.

Audio examples are herein described to show that no intonation problem exists in Beatles' song "Get Back", with the correct tuning of one stave of a keyboard tuned according to the present invention, as shown in FIG. 2. In another song "Hey Jude" intonation problems are "removed" by tuning two staves. As music gets more complicated, such as in an example by Mozart, tuning problems can still be solved by pre-tuning a greater number of keyboards. In such case, it is more preferable or practical to make use of software and a computer. Nevertheless, a correct intonation is achieved if a necessary number of keyboards are "pre-tuned" as will be explained below.

Typically in embodiments of the invention when creating music based on a music score, a computer is used to control the output of an electronic instrument. The computer is programmed to make adjustments to the standard frequency of all the notes so that all the notes are played in accordance with the new scales or templates. The templates are used to provide tuning tables, or virtual keyboards, an assignment to each interval between each pair of adjacent notes (halftones) of one of the values 25/24, 16/15, or 27/25, respectively referred to here as (h), (m) and (s).

There are twelve notes per octave (or extended octave) In the preferred octave "templates" the order of "half-tones" for each template is different and the templates are arranged as follows:

| | |
|---|---|
| Template 1 | s h m h s h s m h m h m |
| Template 2 | s h m h s h s m h m h s |
| Template 3 | h s m h s h s m h m h s |
| Template 4 | h m m h s h s h m m h s |
| Template 5 | s h s h s h m m h m h m |

Instead of dividing each "half-tone" into 100 "cents" (1200 cent per octave), which is normally used in manual calculations, the computer conforms to another common "MIDI" standard of using 4096 divisions so that each one "cent" equals a 40.96 pitch wheel (PW) division. In practice, execution of pitch adjustment is realised through "pitch wheel" commands. Each note on any of the templates can thus be assigned a "pitch wheel" parameter value (bend value). Usually the "bend value" for "chosen" note "A3"=0.

Figure 3:
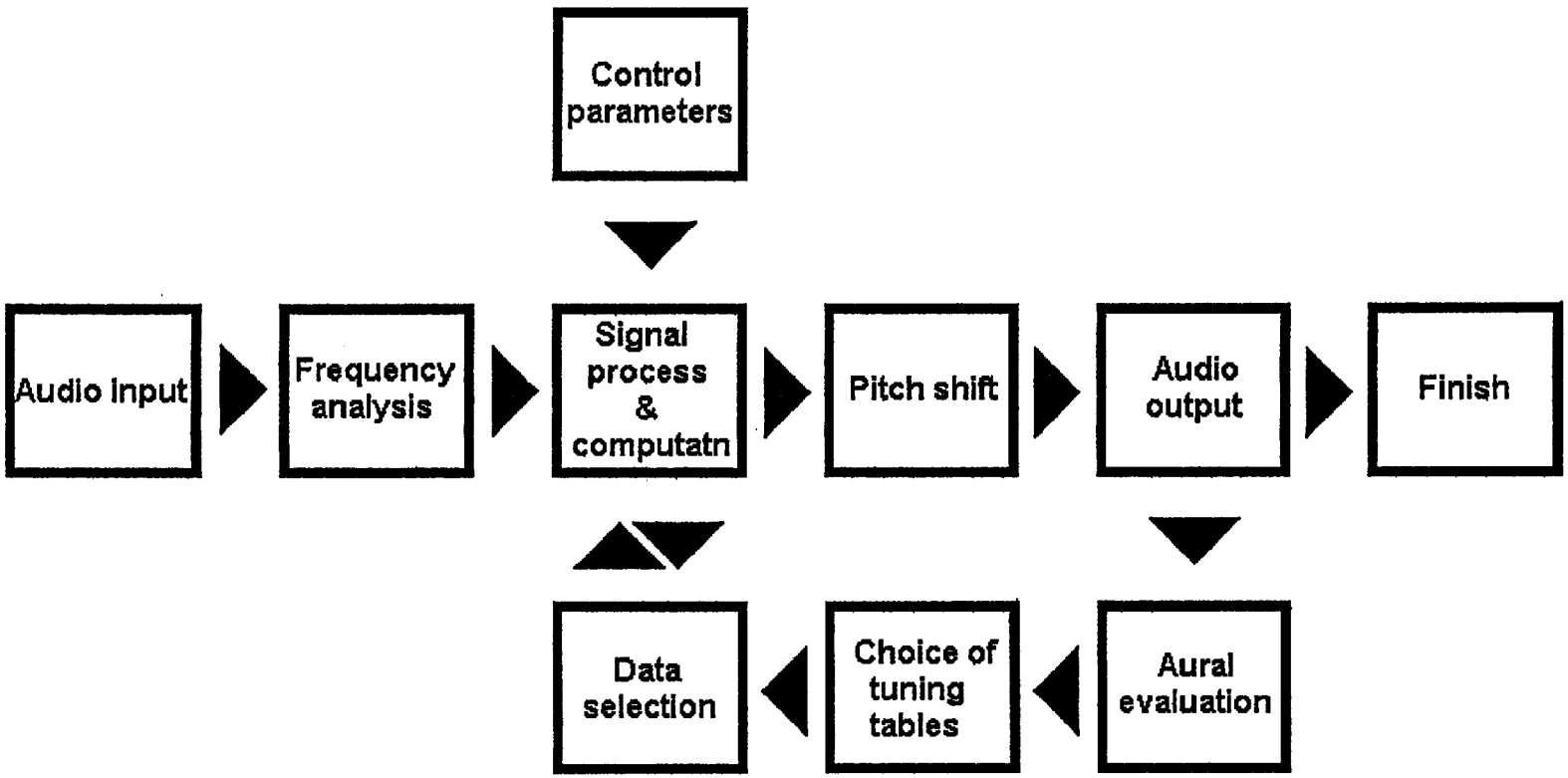
FIG. 3 is a block schematic diagram of apparatus for applying methods of the invention.

FIG. 3 is the block diagram of the above arrangement. The driver makes use of a MIDI "pitch-wheel" command and Tables 1–10 below show typical "listings" of "commands" issued by the computer to an electronic MIDI audio output device instrument. The first column of Tables 3, 6, 8, and 10 shows the "time" at which the command is issued. The second column shows the type of command. Here, "On Note" will cause a musical note, identified by the fourth column, for example, "G 4", meaning the note "G" in the fourth octave, to sound. "Pitch-Wheel" is the command issued by the computer, in accordance with the computer program, to the instrument (output device) to make the required (or sought after) intonation adjustment according to a "template" representing the target intonation in accordance with the invention. For the note "G", it is deduced according to calculation, in order to meet a tuning scheme of the invention, to have a value of minus 80. Therefore, during one unit of time just before an "On Note" command, the "Pitch Wheel" command is issued. The note "G" will therefore sound a little lower (or flatter) in pitch than the corresponding note on an "Equal Tempered" keyboard scale. The third and fifth columns represent the "voice" and "loudness", and are not directly relevant to embodiments of the present invention.

Each unit used in the "Pitch Wheel" command is equal to one "Equal-Tempered" half-tone divided by four thousand and ninety-six. Or, one unit is equal to one octave divided (logarithmically) by (4096×12).

It will be appreciated that:

1. It may be difficult to quantify how "good" the music will sound after applying a template as described.
2. There are many different types of music, and one template may be only applicable to a particular type of music and may not necessarily apply to others.
3. Even though several templates are provided from which people may find it possible to build many new scales, it cannot be claimed that these templates will solve all intonation problems for all types of known music. Other new music created in the future might or might not be capable of aesthetic correction using this invention.

4. Some instruments are not suited to make pitch corrections, such as the piano. Listeners are too used to and familiar with a "well-tempered" piano sound.

In consequence, using embodiments of the present invention requires choice of which music or parts to correct, otherwise the correction might not be pleasing to the listener. However, it is believed that the embodiments are of significant practical use for most music, and especially in applications of the recording industry, to enable "poor" recordings to be rendered more attractive (and marketable) using computerised manipulation of the melodies. In such cases, a programmed computer can be used to apply the templates automatically, even if it is initially necessary empirically or through experience to select appropriately one of the templates for each type or section of the melody.

In order to demonstrate successful uses of embodiments of the present invention, selections of well-known music are considered below. In practice, it can be realized that the resultant performances on a computer driven instrument, "tuned" according to calculations based on the present invention, and played along with a Beatles' original recording, match extremely well each and every note that was inherently or instinctively chosen by a singer. Therefore, it is quite clear that the results of applying this invention at least closely match the natural instincts of the high calibre of musicians, such as the Beatles, to render their melodies pleasing to the listener.

The process is as follows:

1. Input a melody to the computer.
2. Map the notes of a first part of the melody to the template 1. The choice of which note to which element of the template is chosen by experience (or experimentation).
3. Listen to the result. Certain criteria could be applied, but determination by listening is the most satisfactory method.
4. If the melody does not sound good, repeat step 2 through step 3 by the mapping of notes to a next element of template 1, and so forth.
5. If none of the choices available for the template 1 produce a good result, then try the template 2, and repeat the above steps.
6. If all these procedures fail, then the music is not suitable for this application.
7. If a satisfactory result is reached, carry on the above steps with the next part of the melody, if appropriate.
8. If a satisfactory result is reached, match the two parts so that they make good harmony by raising or lowering one of the (whole) keyboards. This is done by adding a constant value in all "pitch wheel" parameters. Listening is again used for final determination. Repeat step 7 until all the parts of the melody have been satisfactorily adjusted.

The following analysis shows how the parameters in the "pitch wheel" command relates to the "templates":

The 2/1 ratio (ordinary octave) is divided into 12 equal divisions (half-tones), and is usually divided further into 1200 "cent", with each half-tone being divided into 100 "cent". In "MIDI" music, the pitch wheel command divides, instead, each half-tone into 4096 equal parts. Hence 1 cent=4096/100=40.96 PW divisions.

An interval of a well-tuned perfect fifth (3/2) has a size expressed as ln(3/2)/ln(2)*1200 cent=701.96 cent, whereas an equally divided or equal-tempered (ET) keyboard has a fifth of exactly 700 cent.

Therefore, if the note "A" in a melody is same as the "A" on a "theoretical" piano, which is very well-tuned to 12 ET (both "A"=440 Hz), then the note "E" sung at an interval 3/2, a perfect fifth above this "A", will be 1.96 cent sharper than the corresponding "E" note on the piano.

To get a correct 3/2 interval on the MIDI computer, the note "A" and "E" are each issued a "Pitch Wheel" command, just prior to their being sounded, to offset them by respectively 0 and 80.3 PW units (40.96 unit per cent*1.96 cent=80.3 units).

Similarly, the adjustments for the various intervals are calculated and found to be h (25/24), −1201; m (16/15), 481; s (27/25), 1361.

The following shows the tuning in "Get Back" by the Beatles. Notice that there are two places where there is a rather big interval of 1842 units or 46 cents in excess of an equally tempered "whole-tone", between the notes "C" and "D"; and also between the notes "G" and "A". It is the sum of a minor second and a semitone. Its ratio is 16/15*27/25=144/125.

TABLE 1

A. For horizontal progress of notes ("melodies"):

| | . . . 0 1 2 3 4 5 6 7 8 9 a b 0 . . . | |
|---|---|---|
| 1. | s h m h s h s m h m h m | "Template 1" |
| 2. | s h m h s h s m h m h s | "Template 2" |
| 3. | h s m h s h s m h m h s | "Template 3" |
| 4. | h m m h s h s h m m h s | "Template 3" |
| 5. | s h s h s h m m h m h m | "Template 4" |

TABLE 2

Note "A" is assigned element "8" in template "1".

| 0 | 1 | 2 | 3 | 4 | 5 | 6 | 7 | 8 | 9 | a | b | 0 |
|---|---|---|---|---|---|---|---|---|---|---|---|---|
| | s | h | m | h | s | h | s | m | h | m | h | m |
| | D | | E | | F# | G | | A | | B | C | |
| | 1682 | | 961 | | 1121 | −80 | | 1762 | | 1041 | −160 | |

TABLE 3

| | | | | |
|---|---|---|---|---|
| 3: 59 | Pitch Wheel | chan= 3 | bend=−80 | |
| 60 | On Note | chan= 3 | pitch=G 4 | vol=96 |
| 4: 0 | On Note | chan= 3 | pitch=G 4 | vol=96 |
| 60 | On Note | chan= 3 | pitch=G 4 | vol=96 |
| 105: 1: 59 | Pitch Wheel | chan= 3 | bend=1762 | |
| 60 | On Note | chan= 3 | pitch=A 4 | vol=96 |
| 3:119 | Pitch Wheel | chan= 3 | bend=−80 | |
| 4: 0 | On Note | chan= 3 | pitch=G 4 | vol=96 |
| | Pitch Wheel | chan= 3 | bend=1762 | |
| 60 | On Note | chan= 3 | pitch=A 4 | vol=96 |
| 106: 1: 59 | Pitch Wheel | chan= 3 | bend=−80 | |
| 60 | On Note | chan= 3 | pitch=G 4 | vol=96 |
| 2: 59 | Pitch Wheel | chan= 3 | bend=961 | |
| 60 | On Note | chan= 3 | pitch=E 4 | vol=96 |
| 89 | Pitch Wheel | chan= 3 | bend=1682 | |
| 90 | On Note | chan= 3 | pitch=D 4 | vol=96 |
| 119 | Pitch Wheel | chan= 3 | bend=−160 | |
| 3: 0 | On Note | chan= 3 | pitch=C 4 | vol=96 |
| 119 | Pitch Wheel | chan= 3 | bend=−80 | |
| 4: 0 | On Note | chan= 3 | pitch=G 4 | vol=96 |
| 60 | On Note | chan= 3 | pitch=G 4 | vol=96 |
| 107: 1: 59 | Pitch Wheel | chan= 3 | bend=1121 | |
| 60 | On Note | chan= 3 | pitch=F#4 | vol=96 |
| 2: 0 | On Note | chan= 3 | pitch=F#4 | vol=96 |
| 59 | Pitch Wheel | chan= 3 | bend=961 | |
| 60 | On Note | chan= 3 | pitch=E 4 | vol=96 |
| 3: 0 | On Note | chan= 3 | pitch=E 4 | vol=96 |

TABLE 3-continued

| | | | | |
|---|---|---|---|---|
| 119 | Pitch Wheel | chan= 3 | bend=−160 | |
| 4: 0 | On Note | chan= 3 | pitch=C 4 | vol=96 |
| 60 | On Note | chan= 3 | pitch=C 4 | vol=96 |
| 89 | Pitch Wheel | chan= 3 | bend=1041 | |
| 90 | On Note | chan= 3 | pitch=B 3 | vol=96 |
| 119 | Pitch Wheel | chan= 3 | bend=1762 | |
| 108: 1: 0 | On Note | chan= 3 | pitch=A 3 | vol=84 |

B. For vertical arrangement of notes ("harmony"): In another example, the Mozart piece "Eine Kleine Nachtmusik", in the 1st-violin (channel 2), note D is assigned "element 5" of "template 3".

Quoting the system:

TABLE 4

| | . . . 0 1 2 3 4 5 6 7 8 9 a b 0 . . . | |
|---|---|---|
| 1. | s h m h s h s m h m h m | "Template 1" |
| 2. | s h m h s h s m h m h s | "Template 2" |
| 3. | h s m h s h s m h m h s | "Template 3" |
| 4. | h m m h s h s h m m h s | "Template 4" |
| 5. | s h s h s h m m h m h m | "Template 5" |

Hence:

TABLE 5

| | | | | | | | | | | | | |
|---|---|---|---|---|---|---|---|---|---|---|---|---|
| 0 | 1 | 2 | 3 | 4 | 5 | 6 | 7 | 8 | 9 | a | b | 0 |
| | h | m | m | h | s | h | s | h | m | m | h | s |
| | A | | B | | C# | D | | E | | F# | G | A |
| | 881 | | 160 | | −560 | 801 | | 961 | | 240 | 721 | 881 |

TABLE 6

| | | | | |
|---|---|---|---|---|
| 11: 2: 59 | Pitch Wheel | chan= 2 | bend=721 | |
| 60 | On Note | chan= 2 | pitch=G 4 | vol=44 |
| 81 | Pitch Wheel | chan= 2 | bend=240 | |
| 82 | On Note | chan= 2 | pitch=F#4 | vol=44 |
| 104 | Pitch Wheel | chan= 2 | bend=961 | |
| 105 | On Note | chan= 2 | pitch=E 4 | vol=45 |
| 119 | Pitch Wheel | chan= 2 | bend=801 | |
| 3: 0 | On Note | chan= 2 | pitch=D 4 | vol=49 |
| 119 | Pitch Wheel | chan= 2 | bend=160 | |
| 4: 0 | On Note | chan= 2 | pitch=B 4 | vol=45 |
| 119 | Pitch Wheel | chan= 2 | bend=721 | |
| 12: 1: 0 | On Note | chan= 2 | pitch=G 4 | vol=52 |
| 119 | Pitch Wheel | chan= 2 | bend=961 | |
| 2: 0 | On Note | chan= 2 | pitch=E 4 | vol=49 |
| 119 | Pitch Wheel | chan= 2 | bend=881 | |
| 3: 0 | On Note | chan= 2 | pitch=A 4 | vol=47 |
| 4:119 | Pitch Wheel | chan= 2 | bend=240 | |
| 13: 1: 0 | On Note | chan= 2 | pitch=F#4 | vol=44 |
| 2:59 | Pitch Wheel | chan= 2 | bend=961 | |
| 60 | On Note | chan= 2 | pitch=E 4 | vol=45 |
| 81 | Pitch Wheel | chan= 2 | bend=801 | |
| 82 | On Note | chan= 2 | pitch=D 4 | vol=45 |
| 104 | Pitch Wheel | chan= 2 | bend=−560 | |
| 105 | On Note | chan= 2 | pitch=C#4 | vol=44 |

In 2nd-violin (channel 3), note D is assigned "element 7".

TABLE 7

| | | | | | | | | | | | | |
|---|---|---|---|---|---|---|---|---|---|---|---|---|
| 0 | 1 | 2 | 3 | 4 | 5 | 6 | 7 | 8 | 9 | a | b | 0 |
| | h | m | m | h | s | h | s | h | m | m | h | s |
| G | | A | A# | B | | C# | D | | E | | F# | G |
| 721 | | 0 | −1200 | −720 | | −560 | 801 | | 80 | | −640 | 721 |

TABLE 8

| | | | | |
|---|---|---|---|---|
| 25: 1: 0 | On Note | chan= 3 | pitch=G 4 | vol=92 |
| 59 | Pitch Wheel | chan= 3 | bend=−640 | |
| 60 | On Note | chan= 3 | pitch=F#4 | vol=90 |
| 119 | Pitch Wheel | chan= 3 | bend=801 | |
| 2: 0 | On Note | chan= 3 | pitch=D 4 | vol=82 |
| 59 | Pitch Wheel | chan= 3 | bend=−640 | |
| 60 | On Note | chan= 3 | pitch=F#4 | vol=78 |
| 3: 0 | On Note | chan= 3 | pitch=F#4 | vol=82 |
| 59 | Pitch Wheel | chan= 3 | bend=80 | |
| 60 | On Note | chan= 3 | pitch=E 4 | vol=86 |
| 119 | Pitch Wheel | chan= 3 | bend=801 | |
| 4: 0 | On Note | chan= 3 | pitch=D 4 | vol=100 |
| 59 | Pitch Wheel | chan= 3 | bend=−560 | |
| 60 | On Note | chan= 3 | pitch=C#4 | vol=95 |
| 119 | Pitch Wheel | chan= 3 | bend=801 | |
| 26: 1: 0 | On Note | chan= 3 | pitch=D 4 | vol=90 |
| 59 | Pitch Wheel | chan= 3 | bend=−640 | |
| 60 | On Note | chan= 3 | pitch=F#3 | vol=65 |
| 119 | Pitch Wheel | chan= 3 | bend=721 | |
| 2: 0 | On Note | chan= 3 | pitch=G 3 | vol=74 |
| 60 | On Note | chan= 3 | pitch=G 3 | vol=74 |
| 119 | Pitch Wheel | chan= 3 | bend=0 | |
| 3: 0 | On Note | chan= 3 | pitch=A 3 | vol=74 |
| 60 | On Note | chan= 3 | pitch=A 3 | vol=78 |
| 119 | Pitch Wheel | chan= 3 | bend=−640 | |
| 4: 0 | On Note | chan= 3 | pitch=F#3 | vol=70 |
| 60 | On Note | chan= 3 | pitch=F#3 | vol=68 |
| 119 | Pitch Wheel | chan= 3 | bend=80 | |
| 27: 1: 0 | On Note | chan= 3 | pitch=E 3 | vol=78 |

On viola and cello (channels 4 and 5), note "D" is assigned "element a".

TABLE 9

| | | | | | | | | | | | | |
|---|---|---|---|---|---|---|---|---|---|---|---|---|
| 0 | 1 | 2 | 3 | 4 | 5 | 6 | 7 | 8 | 9 | a | b | 0 |
| | h | m | m | h | s | h | s | h | m | m | h | s |
| E | | F# | G | | A | A# | B | | C# | D | | E |
| 80 | | −640 | 160 | | 0 | −1200 | 160 | | −560 | −80 | | 80 |

TABLE 10

| | | | | |
|---|---|---|---|---|
| 35: 1: 0 | On Note | chan= 4 | pitch=F#3 | vol=92 |
| 59 | Pitch Wheel | chan= 4 | bend=−560 | |
| 60 | On Note | chan= 4 | pitch=C#3 | vol=95 |
| 119 | Pitch Wheel | chan= 4 | bend=−79 | |
| 2: 0 | On Note | chan= 4 | pitch=D 3 | vol=105 |
| 59 | Pitch Wheel | chan= 4 | bend=81 | |
| 60 | On Note | chan= 4 | pitch=E 3 | vol=95 |
| 119 | Pitch Wheel | chan= 4 | bend=−640 | |
| 3: 0 | On Note | chan= 4 | pitch=F#3 | vol=105 |
| 60 | On Note | chan= 4 | pitch=F#3 | vol=100 |
| 119 | Pitch Wheel | chan= 4 | bend=−159 | |
| 4: 0 | On Note | chan= 4 | pitch=G 3 | vol=105 |
| 60 | On Note | chan= 4 | pitch=G 3 | vol=101 |
| 119 | Pitch Wheel | chan= 4 | bend=1 | |
| 36: 1: 0 | On Note | chan= 4 | pitch=A 3 | vol=105 |
| 60 | On Note | chan= 4 | pitch=A 3 | vol=95 |
| 119 | Pitch Wheel | chan= 4 | bend=−1200 | |
| 2: 0 | On Note | chan= 4 | pitch=A#3 | vol=105 |
| 60 | On Note | chan= 4 | pitch=A#3 | vol=100 |
| 119 | Pitch Wheel | chan= 4 | bend=161 | |
| 3: 0 | On Note | chan= 4 | pitch=B 3 | vol=105 |

Therefore a chord formed by the notes D, A, F♯, and D, by the respective parts 1st-violin, 2nd-violin, viola, and cello, will have PW values on these notes with respective "bend values" 800, 0, −640, and −80 (+20, 0, −16, and −2 cents). The fact that now the note D in 1st violin (PW=800) is different in pitch from the correspondingly same note D in cello (PW=80) provides an embodiment of the invention.

The notes are therefore modified using a relative offset for each part to change the pitch of some corresponding notes of the different parts as Illustrated in FIG. 4.

What is claimed is:

1. A musical template for modifying musical notes prepared in accordance with an equal tempered scale including octaves having respective frequency ranges extending from a first frequency to a second frequency twice the first frequency, to provide a new scale, including twelve musical notes, redefining all the musical notes of the new scale, beginning with a first reference musical note from the equal tempered scale, by adjusting frequencies of all other notes of the new scale with selected frequency ratios of 16/15, 27/25, and 25/24, according to the template, between every pair of adjacent musical notes, such that each sequence of twelve notes of the new scale extends over a frequency range substantially equal to the frequency range of one of the octaves.

2. The musical template according to claim 1, in which the frequency ratios of the new scale are in a sequence of s, h, m, h, s, h, s, m, h, m, h, m, where s=27/25, h=25/24, and m=16/15.

3. The musical template according to claim 1, in which the frequency ratios of the new scale are in a sequence of s, h, m, h, s, h, s, m, h, m, h, s, where s=27/25, h=25/24, and m=16/15.

4. The musical template according to claim 1, in which the frequency ratios of the new scale are in a sequence of h, s, m, h, s, h, s, m, h, m, h, s, where s=27/25, h=25/24, and m=16/15.

5. The musical template according to claim 1, in which the frequency ratios of the new scale are in a sequence of h, m, m, h, s, h, s, h, m, m, h, s, where s=27/25, h=25/24, and m=16/15.

6. The musical template according to claim 1, in which the frequency ratios of the new scale are in a sequence of s, h, s, h, s, h, m, m, h, m, h, m, where s=27/25, h=25/24, and m=16/15.

7. An electronic music generator comprising:

an audio output device, and a computer arranged to drive the output device, in which the computer is programmed to respond to input data representing musical notes prepared according to an equal tempered scale including octaves having respective frequency ranges extending from a first frequency to a second frequency twice the first frequency, and to modify each musical note to a new scale supplied to the output device, musical notes of the new scale being created by beginning with a reference musical note from the equal tempered scale and adjusting frequencies of all other notes of the new scale in a sequence for the new scale with frequency ratios, between every pair of adjacent musical notes, selected from frequency ratios of 16/15, 27/25, and 25/24, such that each sequence of twelve notes of the new scale extends over a frequency range substantially equal to the frequency range of one of the octaves.

8. The electronic music generator according to claim 7, in which the frequency ratios are in a sequence s, h, m, h, s, h, s, m, h, m, h, m, where s=27/25, h=25/24, and m=16/15.

9. The electronic music generator according to claim 7, in which the frequency ratios of the new scale are in a sequence of s, h, m, h, s, h, s, m, h, m, h, s, where s=27/25, h=25/24, and m=16/15.

10. The electronic music generator according to claim 7, in which the frequency ratios of the new scale are in a sequence of h, s, m, h, s, h, s, m, h, m, h, s, where s=27/25, h=25/24, and m=16/15.

11. The electronic music generator according to claim 7, in which the frequency ratios of the new scale are in a sequence of h, m, m, h, s, h, s, h, m, m, h, s, where s=27/25, h=25/24, and m=16/15.

12. The electronic music generator according to claim 7, in which the frequency ratios of the new scale are in a sequence of s, h, s, h, s, h, m, m, h, m, h, m, where s=27/25, h=25/24, and m=16/15.

13. A method of modifying musical notes prepared in accordance with an equal tempered scale including octaves having respective frequency ranges extending from a first frequency to a second frequency twice the first frequency, comprising providing a new scale, including twelve notes, redefining all the musical notes of the new scale, beginning with a first reference musical note from the equal tempered scale, by adjusting frequencies of all other notes of the new scale with selected frequency ratios of 16/15, 27/25, and 25/24, between every pair of adjacent musical notes, such that each sequence of twelve notes of the new scale extends over a frequency range substantially equal to the frequency range of one of the octaves.

14. The method according to claim 13, in which the frequency ratios of the new scale are in a sequence of s, h, m, h, s, h, s, m, h, m, h, m, where s=27/25, h=25/24, and m=16/15.

15. The method according to claim 13, in which the frequency ratios of the new scale are in a sequence of s, h, m, h, s, h, s, m, h, m, h, s, where s=27/25, h=25/24, and m=16/15.

16. The method according to claim 13, in which the frequency ratios of the new scale are in a sequence of h, s, m, h, s, h, s, m, h, m, h, s, where s=27/25, h=25/24, and m=16/15.

17. The method according to claim 13, in which the frequency ratios of the new scale are in a sequence of h, m, m, h, s, h, s, h, m, m, h, s, where s=27/25, h=25/24, and m=16/15.

18. The method according to claim 13, in which the frequency ratios of the new scale are in a sequence of s, h, s, h, s, h, m, m, h, m, h, m, where s=27/25, h=25/24, and m=16/15.

* * * * *